US008042365B2

(12) United States Patent
Morrison et al.

(10) Patent No.: US 8,042,365 B2
(45) Date of Patent: Oct. 25, 2011

(54) COMPACT SECURITY DEVICE FOR SYSTEMS AND PERIPHERALS

(75) Inventors: John Trevor Morrison, Round Rock, TX (US); Bradley Jackson, Pflugerville, TX (US)

(73) Assignee: Dell Products L.P., Round Rock, TX (US)

( * ) Notice: Subject to any disclaimer, the term of this patent is extended or adjusted under 35 U.S.C. 154(b) by 272 days.

(21) Appl. No.: 12/428,834

(22) Filed: Apr. 23, 2009

(65) Prior Publication Data

US 2010/0269552 A1 Oct. 28, 2010

(51) Int. Cl.
*E05B 69/00* (2006.01)

(52) U.S. Cl. ..... 70/58; 70/14; 70/19

(58) Field of Classification Search ..... 70/14, 18, 70/19, 58

See application file for complete search history.

(56) References Cited

U.S. PATENT DOCUMENTS

| | | | | | |
|---|---|---|---|---|---|
| 2,716,882 | A | * | 9/1955 | Vold et al. | 70/159 |
| 3,341,268 | A | * | 9/1967 | Bickford | 312/100 |
| 3,523,156 | A | * | 8/1970 | Phillips, Jr. | 174/38 |
| 4,212,175 | A | * | 7/1980 | Zakow | 70/58 |
| 4,985,695 | A | * | 1/1991 | Wilkinson et al. | 340/568.3 |
| 5,018,052 | A | * | 5/1991 | Ammon et al. | 361/827 |
| 5,142,442 | A | * | 8/1992 | Daniels et al. | 361/679.48 |
| 5,154,072 | A | * | 10/1992 | Leyden | 70/18 |
| 5,228,319 | A | | 7/1993 | Holley et al. | |
| 5,406,809 | A | | 4/1995 | Igelmund | |
| 5,446,618 | A | * | 8/1995 | Tetsuya et al. | 361/679.37 |
| 5,568,362 | A | * | 10/1996 | Hansson | 361/736 |
| 5,810,461 | A | * | 9/1998 | Ive et al. | 312/223.6 |
| 5,816,081 | A | * | 10/1998 | Johnston | 70/58 |
| 5,957,556 | A | * | 9/1999 | Singer et al. | 312/223.6 |
| 6,053,016 | A | * | 4/2000 | Young | 70/57 |
| 6,075,693 | A | * | 6/2000 | Leman | 361/679.57 |
| 6,095,574 | A | * | 8/2000 | Dean | 292/164 |
| 6,178,089 | B1 | * | 1/2001 | Alfonso et al. | 361/727 |
| 6,185,964 | B1 | | 2/2001 | Addiego | |
| 6,233,791 | B1 | * | 5/2001 | Theis | 24/135 R |
| 6,598,433 | B1 | * | 7/2003 | Malvasio | 70/18 |
| 6,622,532 | B2 | * | 9/2003 | Hsu | 70/14 |
| 6,816,364 | B2 | * | 11/2004 | Helot et al. | 361/679.06 |
| 6,836,405 | B2 | | 12/2004 | Alfonso et al. | |
| 7,028,513 | B2 | * | 4/2006 | Avganim | 70/18 |
| 7,088,577 | B2 | * | 8/2006 | Lauffer et al. | 361/679.21 |
| 7,283,357 | B2 | | 10/2007 | Kim | |
| 7,308,809 | B2 | * | 12/2007 | Lu | 70/58 |
| 7,475,575 | B1 | * | 1/2009 | Greenfield et al. | 70/18 |
| 7,602,605 | B2 | | 10/2009 | Su et al. | |
| 2008/0072633 | A1 | * | 3/2008 | Samuel | 70/58 |

OTHER PUBLICATIONS

Computer Security Cable Lock System; http://www.tufnut.com/category.aspx?id=5; 3 pages, Apr. 2009. The Righton Mouselok; http://www.mouselok.com; 1 page, Apr. 2009.

Noble Locks Desktop Locks; http://www.noblelocks.com/desktop.html; 4 pages, Apr. 2009.

NGORG Cable Management/Security Solution; http://www.noblelocks.com/ngorg.html; 1 page, Apr. 2009.

Kensington; http://us.kensington.com/index.html; 1 page, Apr. 2009.

* cited by examiner

*Primary Examiner* — Suzanne Barrett

(74) *Attorney, Agent, or Firm* — Haynes and Boone, LLP

(57) ABSTRACT

A security device includes a cable securing member defining a slot between an open first end and a closed second end. A channel is provided in the slot and a rib adjacent the channel protrudes into the slot. The open first end includes a tab receiver and a lock receiver. The tab receiver engages a tab attached to a chassis. A cable extending through the channel is not removable due to a lock inserted into the lock receiver and blocking the open first end.

20 Claims, 5 Drawing Sheets

Fig. 6
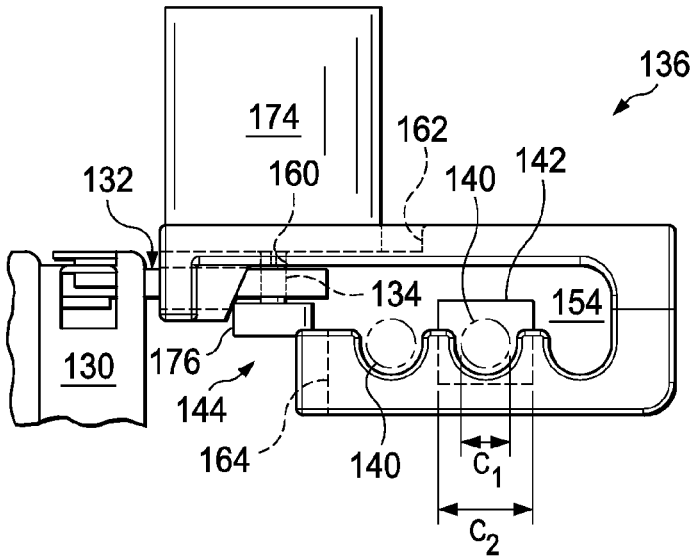
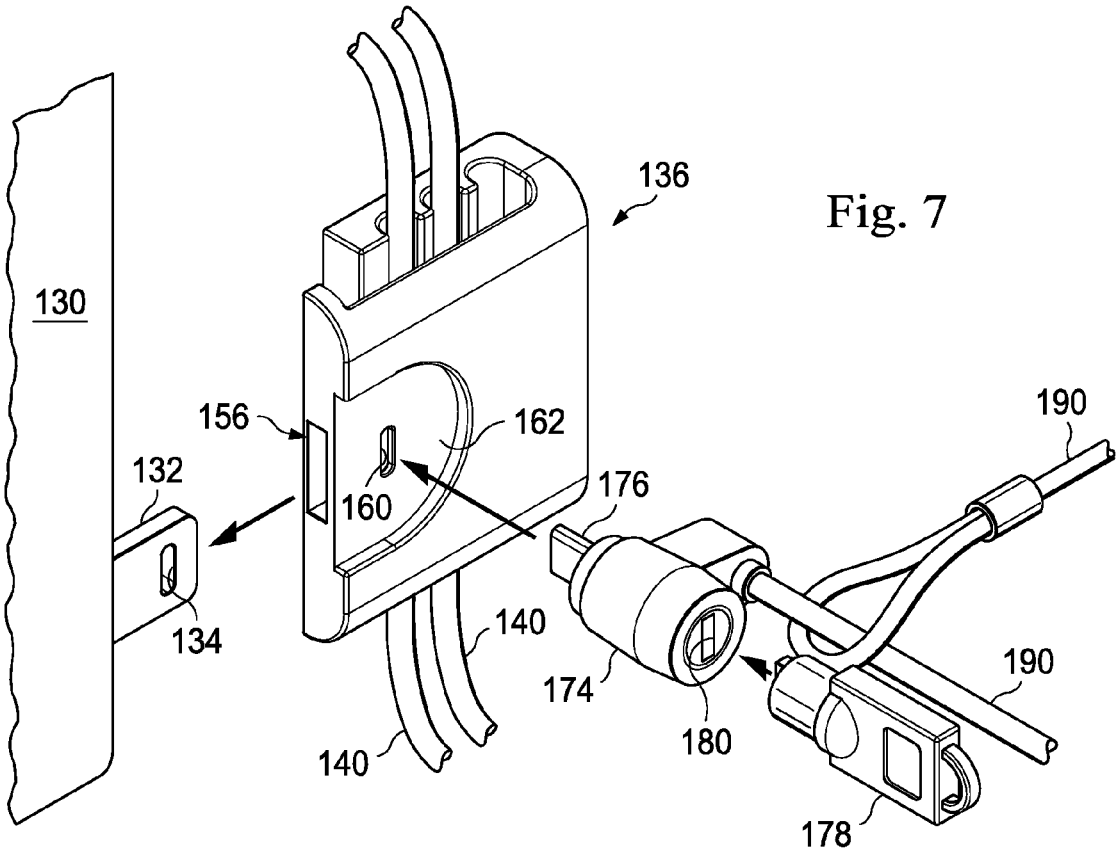
Fig. 7

COMPACT SECURITY DEVICE FOR SYSTEMS AND PERIPHERALS

BACKGROUND

The present disclosure relates generally to information handling systems, and more particularly to a security device for such systems and peripherals attached thereto.

As the value and use of information continues to increase, individuals and businesses seek additional ways to process and store information. One option is an information handling system (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

The protection of peripheral devices, such as mouses and keyboards, is very important. Theft of such items wastes valuable down time and is also costly. Educational labs and kiosks as well as work stations in offices require a security solution which is low-cost, easy to deploy and not overly complex or costly.

Current solutions typically rely on adhesive anchors and steel cables. Specific to peripherals, the prior solutions focus on securing the actual device.

Accordingly, it would be desirable to provide an improved low-cost, easy to deploy security solution for theft prone environments which secures the peripheral cable rather than the peripheral device, absent the disadvantages discussed above.

SUMMARY

According to one embodiment, a security apparatus includes a cable securing member defining a slot between an open first end and a closed second end. A channel is provided in the slot and a rib adjacent the channel and protruding into the slot. The open first end includes a tab receiver and a lock receiver.

BRIEF DESCRIPTION OF THE DRAWINGS

FIG. 6 is a side view illustrating an embodiment of the security device attached to an IHS chassis and secured by a locking device.

FIG. 7 is a perspective view illustrating an embodiment of the security device, chassis, locking device, and a securing cable.

DETAILED DESCRIPTION

For purposes of this disclosure, an IHS may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an IHS may be a personal computer, a PDA, a consumer electronic device, a network server or storage device, a switch router or other network communication device, or any other suitable device and may vary in size, shape, performance, functionality, and price. The IHS may include memory, one or more processing resources such as a central processing unit (CPU) or hardware or software control logic. Additional components of the IHS may include one or more storage devices, one or more communications ports for communicating with external devices as well as various input and output (I/O) devices, such as a keyboard, a mouse, and a video display. The IHS may also include one or more buses operable to transmit communications between the various hardware components.

Figure 1:
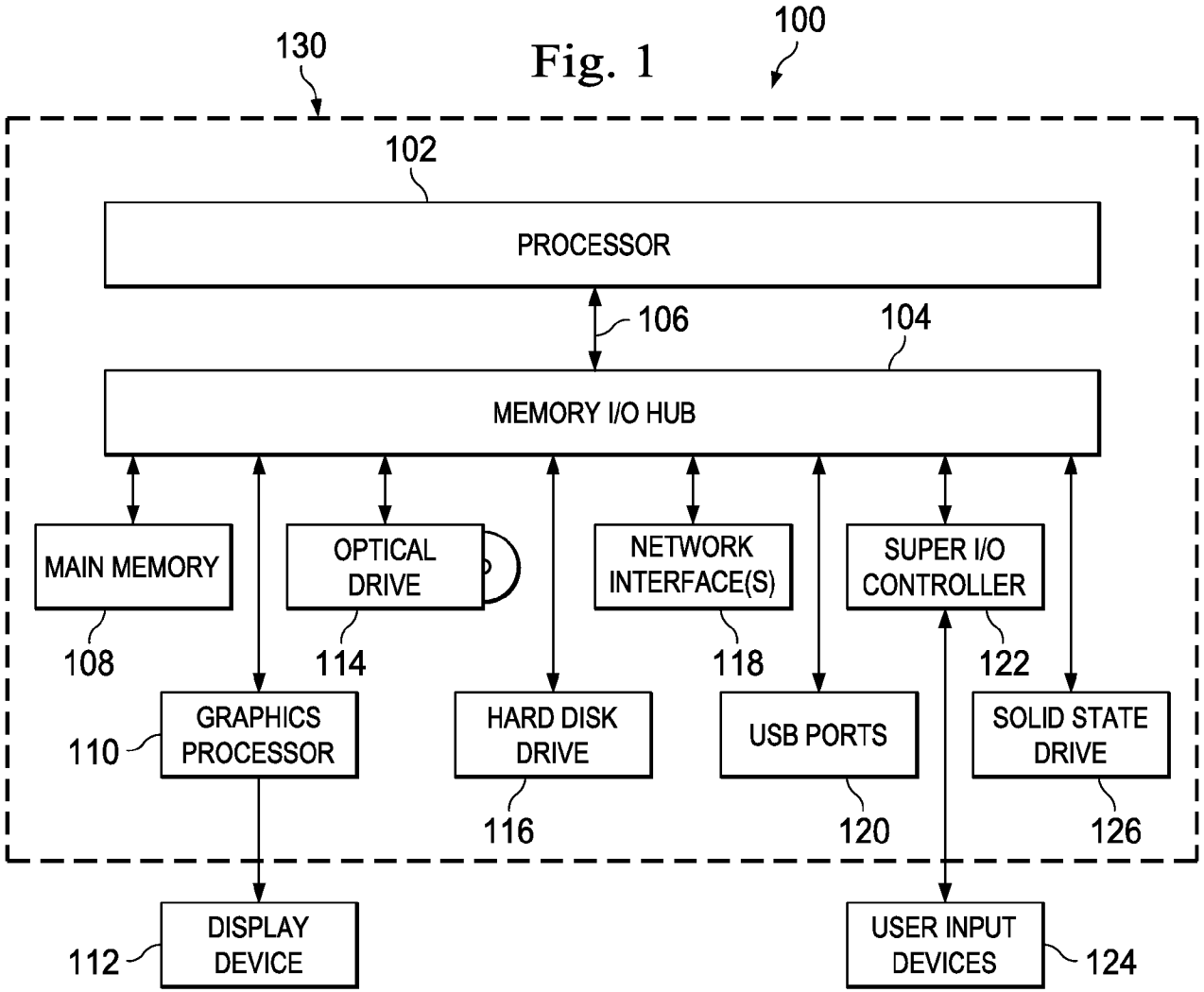
FIG. 1 illustrates an embodiment of an information handling system.

FIG. 1 is a block diagram of an IHS 100. The IHS 100 includes a processor 102 such as an Intel Pentium™ series processor or any other processor available. A memory I/O hub chipset 104 (comprising one or more integrated circuits) connects to processor 102 over a front-side bus 106. Memory I/O hub 104 provides the processor 102 with access to a variety of resources. Main memory 108 connects to memory I/O hub 104 over a memory or data bus. A graphics processor 110 also connects to memory I/O hub 104, allowing the graphics processor to communicate, e.g., with processor 102 and main memory 108. Graphics processor 110, in turn, provides display signals to a display device 112.

Other resources can also be coupled to the system through the memory I/O hub 104 using a data bus, including an optical drive 114 or other removable-media drive, one or more hard disk drives 116, one or more network interfaces 118, one or more Universal Serial Bus (USB) ports 120, and a super I/O controller 122 to provide access to user input devices 124, etc. The IHS 100 may also include a solid state drive (SSDs) 126 in place of, or in addition to main memory 108, the optical drive 114, and/or a hard disk drive 116. It is understood that any or all of the drive devices 114, 116 and 126 may be located locally with the IHS 100, located remotely from the IHS 100, and/or they may be virtual with respect to the IHS 100.

Not all IHSs 100 include each of the components shown in FIG. 1, and other components not shown may exist. Furthermore, some components shown as separate may exist in an integrated package or be integrated in a common integrated circuit with other components, for example, the processor 102 and the memory I/O hub 104 can be combined together. As can be appreciated, many systems are expandable, and include or can include a variety of components, including redundant or parallel resources.

Figure 2:
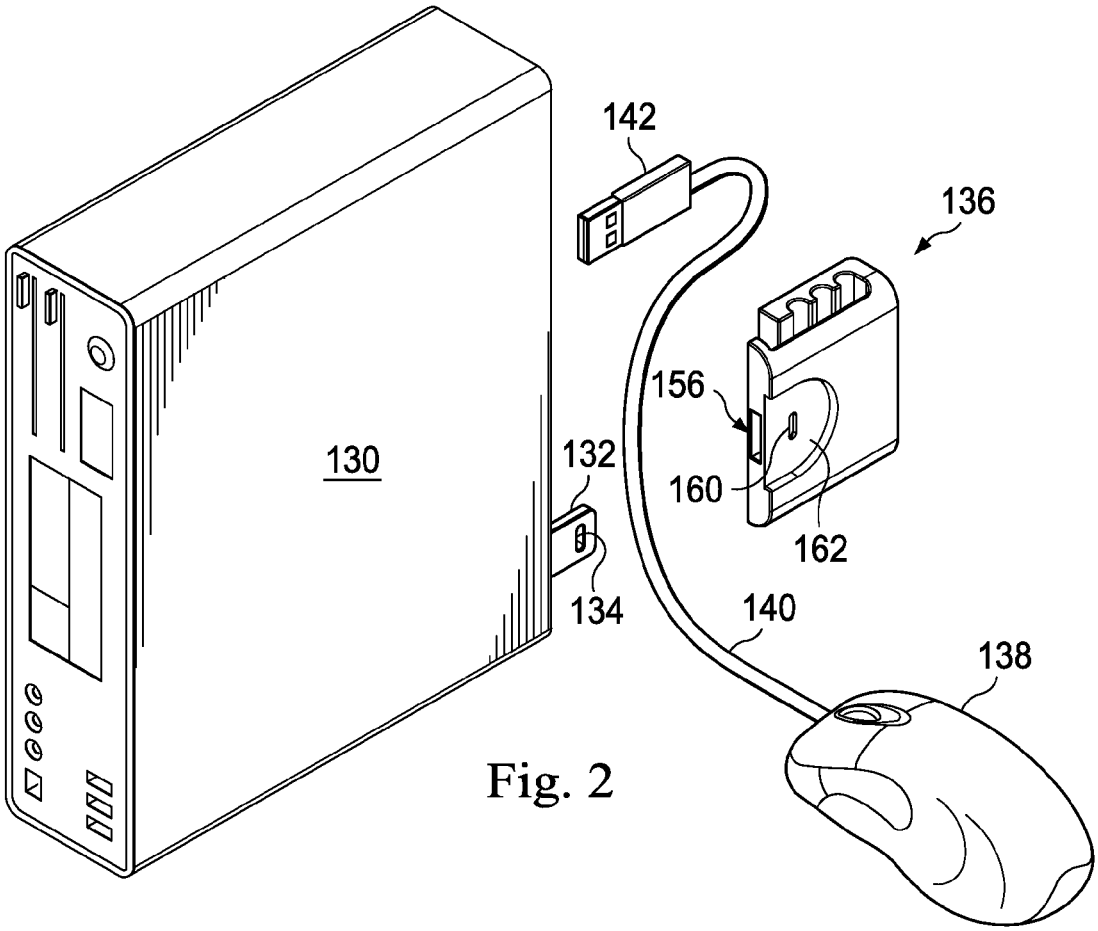
FIGS. 2, 2*a* and 2*b* are each a perspective view illustrating an embodiment of an IHS chassis used with the security device described herein.

Portions of the system 100 are provided in an IHS chassis 130, FIGS. 1 and 2. Other parts of the system 100 such as display 112 and input devices 124, such as a mouse and a keyboard for example are peripherally attached to the system 100. In FIG. 2, chassis 130 includes a tab 132 fixedly attached to, and extending from chassis 130. Tab 132 includes a slot or opening 134 formed therein. In FIG. 2, a cable securing member 136 is also shown along with a mouse 138 including a cable 140 and a cable connector 142.

Figure 3:
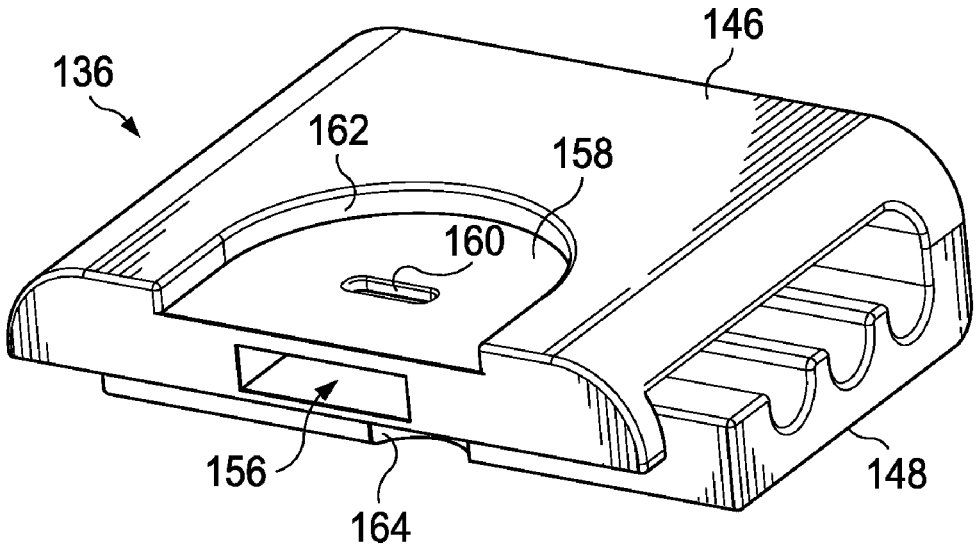
FIGS. 3, 4 and 5 are various views illustrating an embodiment of the security device described herein.
Figure 4:
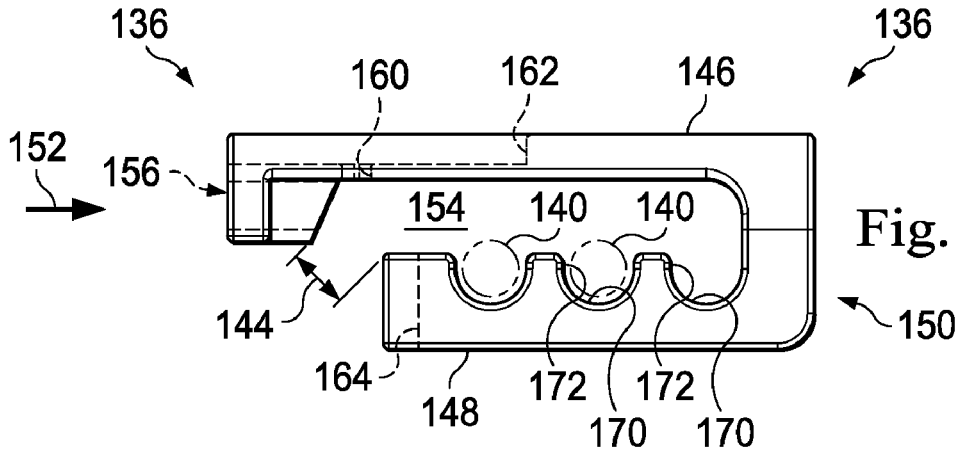
Figure 5:
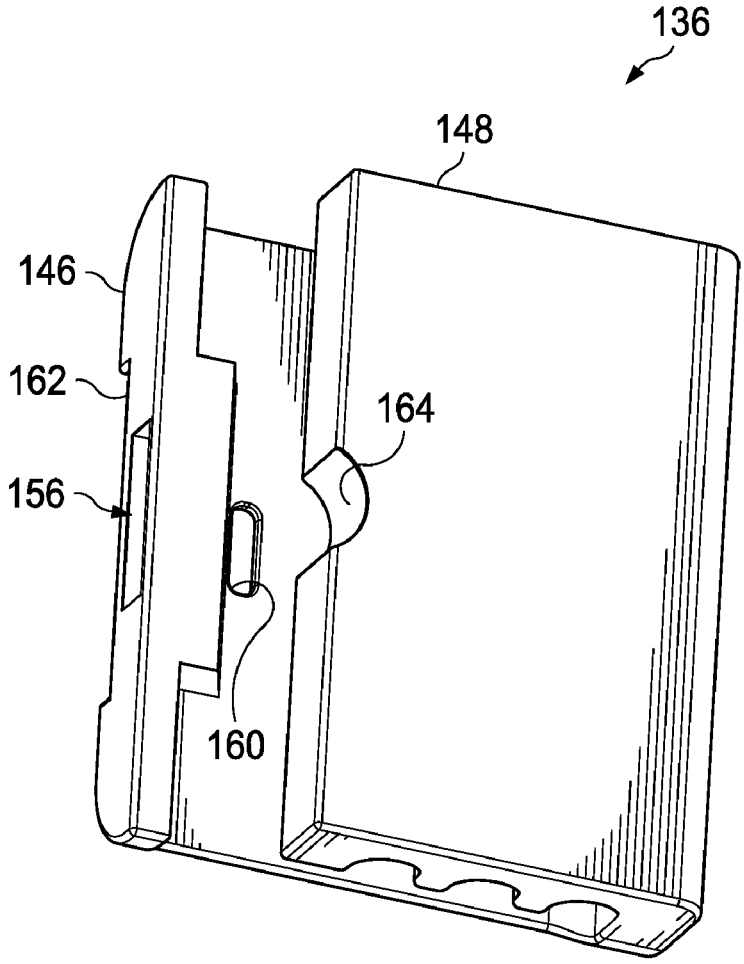

A cable securing member 136, FIGS. 3, 4 and 5, is preferably a cast part formed of a suitable rigid material. The cable securing member 136 is generally a "U" shape and includes a first member 146, a second member 148 opposite the first member 146, a closed end 150, and an open end 152, thus defining a slot 154 between the open end 152 and the closed end 150. The open end 152 defines a cable access slot 144, a tab receiver 156 and a lock receiver 158 including an opening 160 formed in an arcuate recess 162. An arcuate cutout 164 is also formed in the cable securing member 136. More precisely, the tab receiver 156, lock receiver 158, opening 160 and arcuate recess 162 are provided in the first member 146, whereas the cutout 164 is provided in the second member 148. In FIG. 4, a channel, or a plurality of channels 170 are provided in second member 148, and a rib, or a plurality of ribs, 172 are provided adjacent each channel 170. The cable access slot 144 is of a size sufficient to permit a cable, or a plurality of cables, 140 to pass into slot 154 and seat in a channel 170.

Figure 2A:
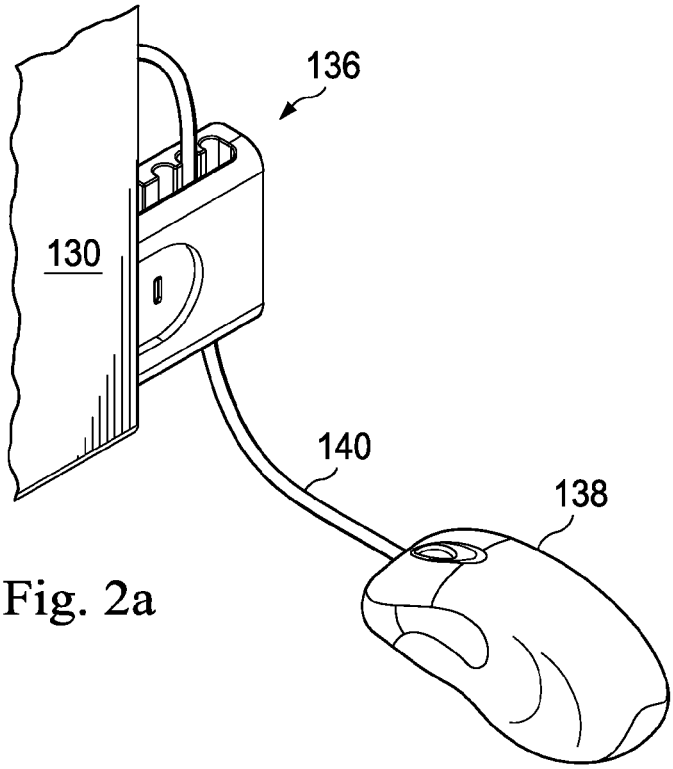
Figure 2B:
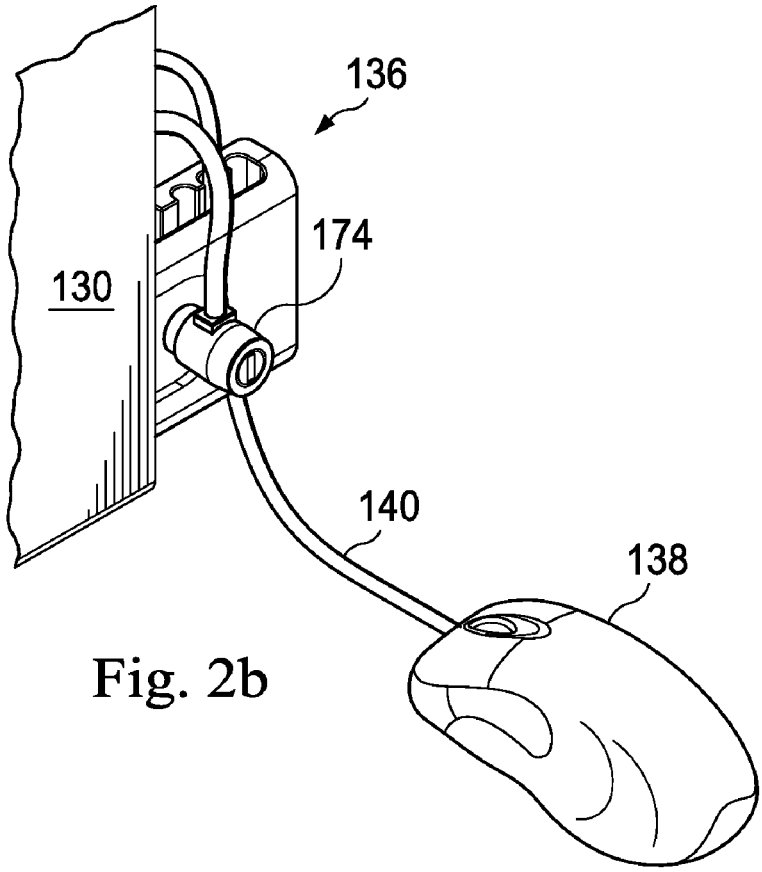

In FIG. 2*a* and 6, the cable securing member 136 is engaged with tab 132 and one or more cables 140, described above, extend through cable securing member 136. As an example, cable 140 is connected to mouse 138 at one end, and includes connector 142 at an opposite end. In FIGS. 6 and 2*b*, a well-known Kensington type lock device 174 is secured to cable securing device 136 as will be further described below.

When cable securing device 136 is fully engaged with tab 132, FIGS. 2, 2*a* and 6, opening 134 of tab 132 is aligned with opening 160 of cable securing device 136. Cable 140 may be passed through slot 144 prior to or after such engagement but before locking device 174 is attached. The locking device 174 is seated in recess 162. A rotatable lock member 176 is aligned with and passes through the aligned slots or openings 134 and 160 and is positioned in arcuate cutout 164 to permit rotation of lock member 176.

A key member 178, FIGS. 6 and 7, is inserted into a key slot 180 in lock 174 and the key 178 is rotated 90° which causes rotatable lock member 176 to also rotate 90° relative to the aligned slots 134, 160. This rotation restricts the lock member from being withdrawn through the aligned slots 134, 160 due to such rotation. Key member 178 is withdrawn from slot 180 and kept secure until unlocking of lock 174 is required. As a result, the cable access slot 144 is blocked by rotatable lock member 176 to restrict cable 140 from being removed from cable securing member 136.

Each cable 140, FIGS. 2, 4 and 6, has a cross-sectional size or a diameter C1, depending on the geometric cross-section. Likewise, the permanently attached connector 142, or overmold, has a greater than C1 cross-sectional size or a diameter C2, also depending on the geometric cross-section. Slot 154, is of a size sufficient for cable 140 to pass through as is cable access slot 144. However, due to the greater size of connector 142, cable 144 may not be longitudinally withdrawn from cable securing member 136, e.g. via channel 170 or slot 154. Thus, only movement of cable 140 through cable access slot 144 will permit cable 140 to be inserted into or withdrawn from cable securing member 136.

A steel cable member 190, FIG. 7, commonly used in combination with a Kensington-type lock 174, extends from lock 174 and is secured around or to a fixed or secure device (not shown). As a result of the above, the cable securing device 136 secures peripheral cable 140 to chassis 130.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A security apparatus, comprising:

a cable securing member including an open first end and a closed second end and defining a slot between the open first end and the closed second end;

a plurality of ribs extending from the cable securing member and into the slot, the plurality of ribs defining a plurality of channels that each are operable to accept a peripheral device cable; and a tab receiver and a lock receiver located on the open first end of the cable securing member;

wherein the cable securing member is an integral member that is operable to be secured to a chassis by engaging a tab on the chassis with the tab receiver and engaging a lock with the lock receiver, and wherein the cable securing member is operable to be decoupled and separated from the chassis by disengaging the lock and the lock receiver and disengaging the tab and the tab receiver.

2. The apparatus of claim 1, wherein the cable securing member being operable to be decoupled and separated from the chassis includes the plurality of ribs defining the plurality of channels being operable to be decoupled and separated from the chassis by disengaging the lock and the lock receiver and disengaging the tab and the tab receiver.

3. The apparatus of claim 1, wherein each of the plurality of channels is located in a side-by-side orientation with an adjacent channel.

4. A security system, comprising:

a chassis;

a tab extending from the chassis;

a cable securing member including an open first end and a closed second end and defining a slot between the open first end and the closed second end;

a plurality of ribs extending from the cable securing member and into the slot, the plurality of ribs defining a plurality of channels that each are operable to accept a peripheral device cable; and a tab receiver and a lock receiver located on the open first end of the cable securing member;

wherein the cable securing member is an integral member that is secured to the chassis through the engagement of the tab on the chassis and the tab receiver and the engagement of a lock and the lock receiver, and wherein the cable securing member is operable to be decoupled and separated from the chassis by disengaging the lock and the lock receiver and disengaging the tab and the tab receiver.

5. The system of claim 4, wherein the tab defines a tab opening that is aligned with a lock receiver opening defined by the lock receiver due to the engagement of the tab and the tab receiver.

6. The system of claim 4, further comprising:

a peripheral device cable located in one of the plurality of channels.

7. The system of claim 4, wherein the lock receiver includes a lock opening defined by the cable securing member and extending through the cable securing member to the slot, and wherein the lock receiver includes a lock recess defined by the cable securing member adjacent the lock opening.

8. The system of claim 4 further comprising:

a lock including a locking device extending through the lock receiver and the tab such that the open first end is blocked by the locking device, the cable securing member is secured to the chassis, and a peripheral device cable is secured in the slot.

9. An information handling system (IHS), comprising:

an IHS chassis;

a processor housed in the IHS chassis;

a memory coupled to the processor;

a peripheral device coupled to the processor through a peripheral device cable that connects the peripheral device to the IHS chassis;

a tab extending from the IHS chassis;

a cable securing member including an open first end and a closed second end and defining a slot between the open first end and the closed second end;

a plurality of ribs extending from the cable securing member and into the slot, the plurality of ribs defining a plurality of channels, wherein the peripheral device cable is positioned in one of the plurality of channels; and a tab receiver and a lock receiver located on the open first end of the cable securing member;

wherein the cable securing member is an integral member that is secured to the IHS chassis through the engagement of the tab on the IHS chassis and the tab receiver and the engagement of a lock and the lock receiver, and wherein the cable securing member is operable to be decoupled and separated from the IHS chassis by disengaging the lock and the lock receiver and disengaging the tab and the tab receiver.

10. The system of claim 9, wherein the tab defines a tab opening that is aligned with a lock receiver opening defined by the lock receiver due to the engagement of the tab with the tab receiver.

11. The system of claim 9, wherein the lock receiver includes a lock opening defined by the cable securing member and extending through the cable securing member to the slot, and wherein the lock receiver includes a lock recess defined by the cable securing member adjacent the lock opening.

12. The system of claim 11 further comprising:

a lock including a locking device extending through the lock receiver and the tab such that the open first end is blocked by the locking device, the cable securing member is secured to the chassis, and the peripheral device cable is secured in the slot.

13. The apparatus of claim 11, further comprising:

a locking device cut-out defined by the cable securing member on the open first end.

14. The apparatus of claim 11, further comprising:

a plurality of peripheral devices, each including a peripheral device cables connecting a respective peripheral device to the chassis wherein each peripheral device cable is positioned in a respective one of the plurality of channels.

15. The system of claim 9, wherein the peripheral device cable includes at least one connector end having an attached connector.

16. The system of claim 15, wherein the cable includes a cross-section of a first size and the connector includes a cross-section of a second size greater than the first size.

17. The system of claim 16, wherein second size of the connector end resists the removal of the connector end of the cable through the slot.

18. The system of claim 14, wherein each peripheral device cable includes at least one connector end having an attached connector.

19. The system of claim 18, wherein each cable includes a cross-section of a first size and each respective connector includes a cross-section of a second size greater than the first size.

20. The system of claim 19, wherein second size of the connector ends resist the removal of the connector end of a respective cable through the slot.

* * * * *

UNITED STATES PATENT AND TRADEMARK OFFICE

CERTIFICATE OF CORRECTION

PATENT NO. : 8,042,365 B2
APPLICATION NO. : 12/428834
DATED : October 25, 2011
INVENTOR(S) : John Trevor Morrison and Bradley Jackson It is certified that error appears in the above-identified patent and that said Letters Patent is hereby corrected as shown below:

Column 4, line 21, before the word chassis, delete "the"

Column 6, line 13, the word "cables" should be --cable--

Signed and Sealed this
Thirty-first Day of July, 2012

David J. Kappos

David J. Kappos
*Director of the United States Patent and Trademark Office*